US005913511A

United States Patent [19]

Miyauchi

[11] Patent Number: 5,913,511

[45] Date of Patent: Jun. 22, 1999

[54] SHEET CONVEYING APPARATUS

[75] Inventor: Yasuo Miyauchi, Machida, Japan

[73] Assignee: Canon Kabushiki Kaisha, Tokyo, Japan

[21] Appl. No.: 08/842,044

[22] Filed: Apr. 23, 1997

[30] Foreign Application Priority Data

Apr. 25, 1996 [JP] Japan ..... 8-105896

[51] Int. Cl.[6] ..... B65H 5/26

[52] U.S. Cl. ..... 271/9.09; 271/9.13; 271/274; 271/275

[58] Field of Search ..... 271/9.01, 9.09, 271/9.13, 264, 274, 275, 225, 314, 184, 185, 186

[56] References Cited

U.S. PATENT DOCUMENTS

| | | | |
|---|---|---|---|
| 5,409,209 | 4/1995 | Nakamura et al. | 271/314 |
| 5,563,698 | 10/1996 | Okada | 271/9.09 |
| 5,734,404 | 3/1998 | Komuro et al. | 271/275 |

FOREIGN PATENT DOCUMENTS

| | | | |
|---|---|---|---|
| 0 514 155 | 11/1992 | European Pat. Off. . | |
| 0 573 272 | 12/1993 | European Pat. Off. . | |
| 355066432 | 5/1980 | Japan | 271/9.09 |
| 2-147524 | 6/1990 | Japan . | |
| 405024715 | 2/1993 | Japan | 271/9.09 |

*Primary Examiner*—H. Grant Skaggs
*Attorney, Agent, or Firm*—Fitzpatrick, Cella, Harper & Scinto

[57] ABSTRACT

In the present invention, a U-turn path is formed by facing an outer guide surface of a guide member to an outer peripheral surface of a convey roller. A terminal edge of the outer guide surface forming a part of an outlet of the U-turn path is configured not to coincide with a straight line but is tapered to be convex at a central portion. When a thick sheet is conveyed through the U-turn path, a trail end of the thick sheet is shifted to the terminal edge while rubbing the outer guide surface. Then, the trail end of the sheet leaves the terminal edge. Since the terminal edge has the tapered configuration, the trail end of the sheet is gradually disengaged from the terminal edge, thereby preventing the snapping restoring action of the trail end to weaken the shock.

9 Claims, 7 Drawing Sheets

SHEET CONVEYING APPARATUS

BACKGROUND OF THE INVENTION

1. Field of the Invention

The present invention relates to a sheet conveying apparatus having a U-turn path.

2. Related Background Art

FIG. 6 is a perspective view of a conventional sheet conveying apparatus having a so-called U-turn path for greatly changing a conveying direction of a sheet. This apparatus comprises a convey roller 100 rotated in a direction shown by the arrow R100, a convey guide 101 having an outer guide surface 101*a* facing to an outer peripheral surface 100*a* of the convey roller 100, and a pinch roller (convey sub-roller) 102 disposed downstream of the convey guide 101 in a rotating direction of the convey roller 100. Between the outer peripheral surface 100*a* of the convey roller 100 and the outer guide surface 101*a* of the guide 101, there is disposed an arc-shaped U-turn path G through which the sheet is passed. The pinch roller 102 is rotatably mounted on a front end of a pressure plate 103 rocked around a shaft 103*a*, and a rear end of the pressure plate 103 is biased upwardly by a pair of tension springs 104 so that the pinch roller is urged against the outer peripheral surface 100*a* of the convey roller 100 with moderate pressure from the above. Incidentally, a downstream outlet Gb of the U-turn path G is defined as a straight gap formed between the generatrix of the convey roller 100 and a terminal edge 101*b* of the outer guide surface 101*a* of the guide 101.

The sheet fed to an inlet Ga of the U-turn guide G from a direction shown by the arrow A is conveyed through the U-turn path G by the convey roller 100 rotating in the direction R100. When a tip end of the sheet leaves the outlet Gb, the tip end of the sheet reaches the pinch roller 102 while being guided by a lower surface of the pressure plate 103. When the tip end of the sheet reaches the pinch roller 102, the sheet is conveyed by the convey roller 100 and the pinch roller 102. As the sheet is further conveyed, a trail end of the sheet passes through the outlet Gb of the U-turn path G and then leaves through the pinch roller 102. Then, the sheet is conveyed to, for example, a downstream image forming portion.

However, in the above-mentioned conventional sheet conveying apparatus, when a sheet (for example, a thick sheet) having great resiliency is conveyed and image formation is effected regarding the thick sheet at the downstream image forming portion, there arose a problem that a good image could not often be formed. That is to say, as shown in FIG. 7, since the sheet P having great resiliency is hard to be bent or curved, when the sheet is being conveyed through the U-turn path G, it is forcibly curved in accordance with a curvature of the U-turn path G. As a result, the tip and trail ends of the sheet rub the outer guide surface 101*a* of the guide 101. And, when the trail end Pb of the sheet P leaves the outlet Gb of the U-turn path G, i.e., when the trail end Pb is disengaged from the terminal edge 101*b* of the outer guide surface 101*a* of the guide 101, since the trail end Pb of the sheet P is abruptly returned from a posture shown by the solid line to a posture shown by the broken line by the resiliency (storing force) of the sheet P, a convey amount of the sheet P becomes unstable due to the shock, thereby worsening the image quality.

For example, as shown in FIG. 7, when a recording apparatus 105 includes a recording means 106 disposed immediately downstream of the pinch roller 102, since the sheet P is intermittently conveyed by the convey roller 100 by a predetermined amount and one-line recording is effected by the recording means 106, if the convey amount of the sheet P does not coincide with the recording width (in the conveying direction), a recording area will be deviated from a correct one, so that the desired image cannot be obtained. If the convey roller 100 is stopped in a condition (as shown by the solid line) that the trail end Pb of the sheet P is slightly caught by the terminal edge 101*b* of the outer guide surface 101*a*, the trail end Pb of the sheet is snappingly disengaged from the terminal edge 101*b* to reach the posture shown by the broken line. In this case, due to the presence of any play in a drive transmitting system for the convey roller 100 and any plays in bearings, the desired convey amount cannot be obtained. To eliminate such inconvenience, there is proposed a technique in which a braking means is incorporated into the drive transmitting system to minimize influence of the play. However, in this case, since load torque is increased and greater motor torque is required, a desired result cannot be achieved.

As another proposal, there has been provided a technique in which a flexible sheet member (for example, PET sheet member) is adhered to the guide 101 so that a buffer (provided by the flexible sheet member) is formed between the terminal edge 101*b* of the outer guide surface 101*a* and the pressure plate 103, to thereby eliminate the above drawback. However, in this case, if the sheet member is not adhered to the guide at a correct or accurate position, the sheet jam may frequently be caused. Thus, the accuracy of adhesion must be maintained, which in turn worsen the operability.

SUMMARY OF THE INVENTION

An object of the present invention is to provide a sheet conveying apparatus which can prevent dispersion of a convey amount of a sheet caused due to a restoring force of the sheet generated when a trail end of the sheet is disengaged from a terminal edge of an outer guide surface, with a simple construction and without using an additional means such as a braking means or a flexible sheet member.

According to a preferred aspect of the present invention, a sheet conveying apparatus comprises an arc-shaped U-turn path formed between an outer peripheral surface of a convey roller for conveying a sheet and an outer guide surface curved along the outer peripheral surface to convey the sheet passed through the U-turn path by the convey roller and a convey sub-roller urged against the convey roller. The outer guide surface has a terminal edge disposed at downstream end thereof in a sheet conveying direction and cooperating with the generatrix of the outer peripheral surface to define an outlet of the U-turn path therebetween, and the terminal edge is configured not to coincide with a straight line parallel with a longitudinal axis of the convey roller.

Also, the sheet conveying apparatus further comprises a pressurizing member for urging the convey sub-roller against the outer peripheral surface of the convey roller, and the pressurizing member has an auxiliary guide surface facing to the outer peripheral surface of the convey roller between the outlet of the U-turn path and the convey sub-roller.

Also, the pressurizing member has a second guide surface contiguous to the upstream auxiliary guide surface so that the second guide surface and the auxiliary guide surface form a part of a straight path extending to the convey sub-roller.

With the arrangement as mentioned above, since the terminal edge of the outer guide surface is configured not to coincide with the straight line parallel with the longitudinal axis of the convey roller, for example, even when a trail end of a sheet (such as a thick sheet) having great resiliency is disengaged from the terminal edge of the outer guide surface, the entire trail end of the sheet is not disengaged from the terminal edge of the outer guide surface at once. Thus, the trail end of the sheet is gradually disengaged from the terminal edge, so that the restoring force can be weakened.

DETAILED DESCRIPTION OF THE PREFERRED EMBODIMENTS

The present invention will now be explained in connection with embodiments thereof with reference to the accompanying drawings.

<First Embodiment>

Figure 1:
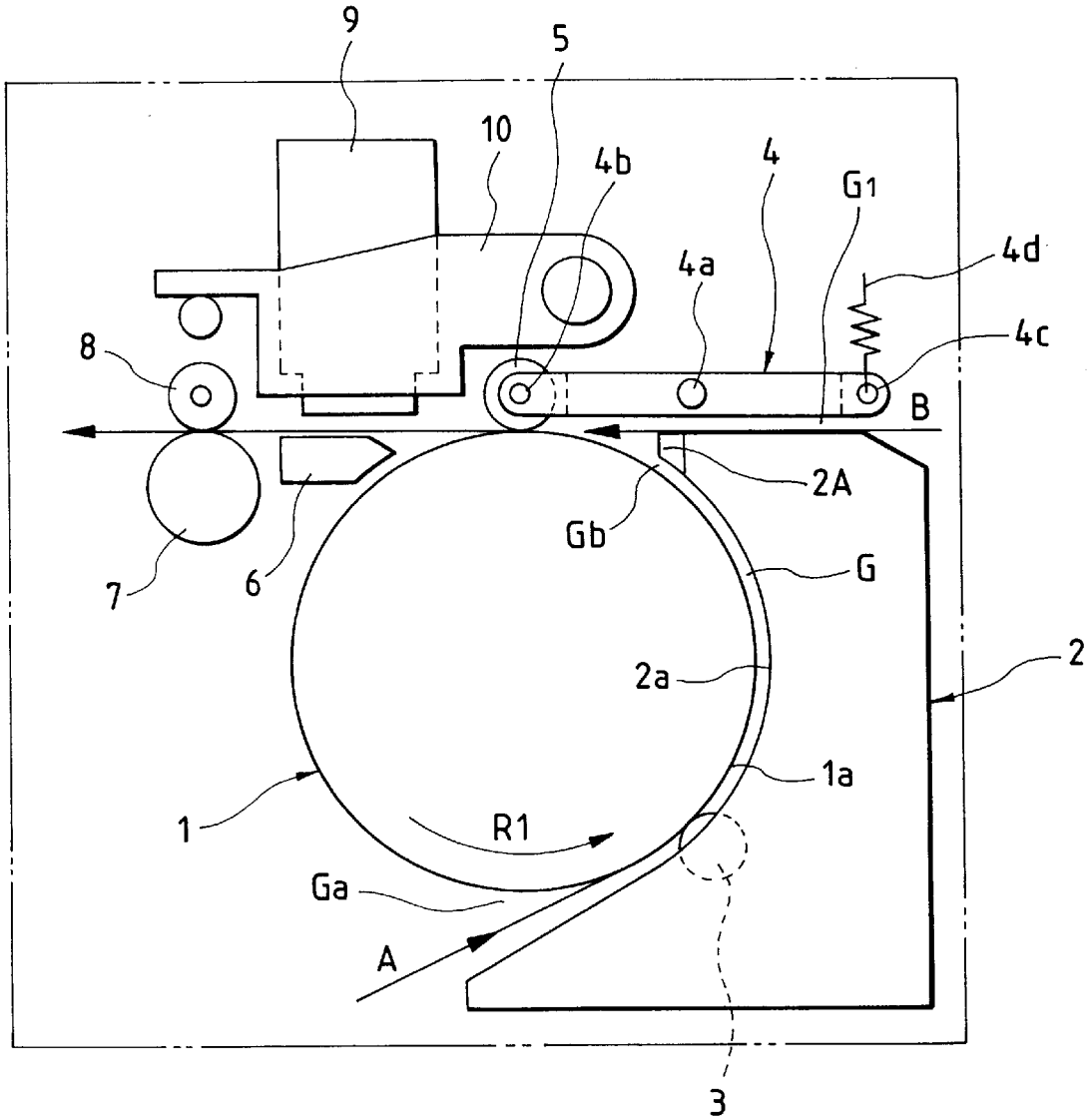
FIG. 1 is an elevational sectional view of a sheet conveying apparatus according to a first embodiment of the present invention.
Figure 2:
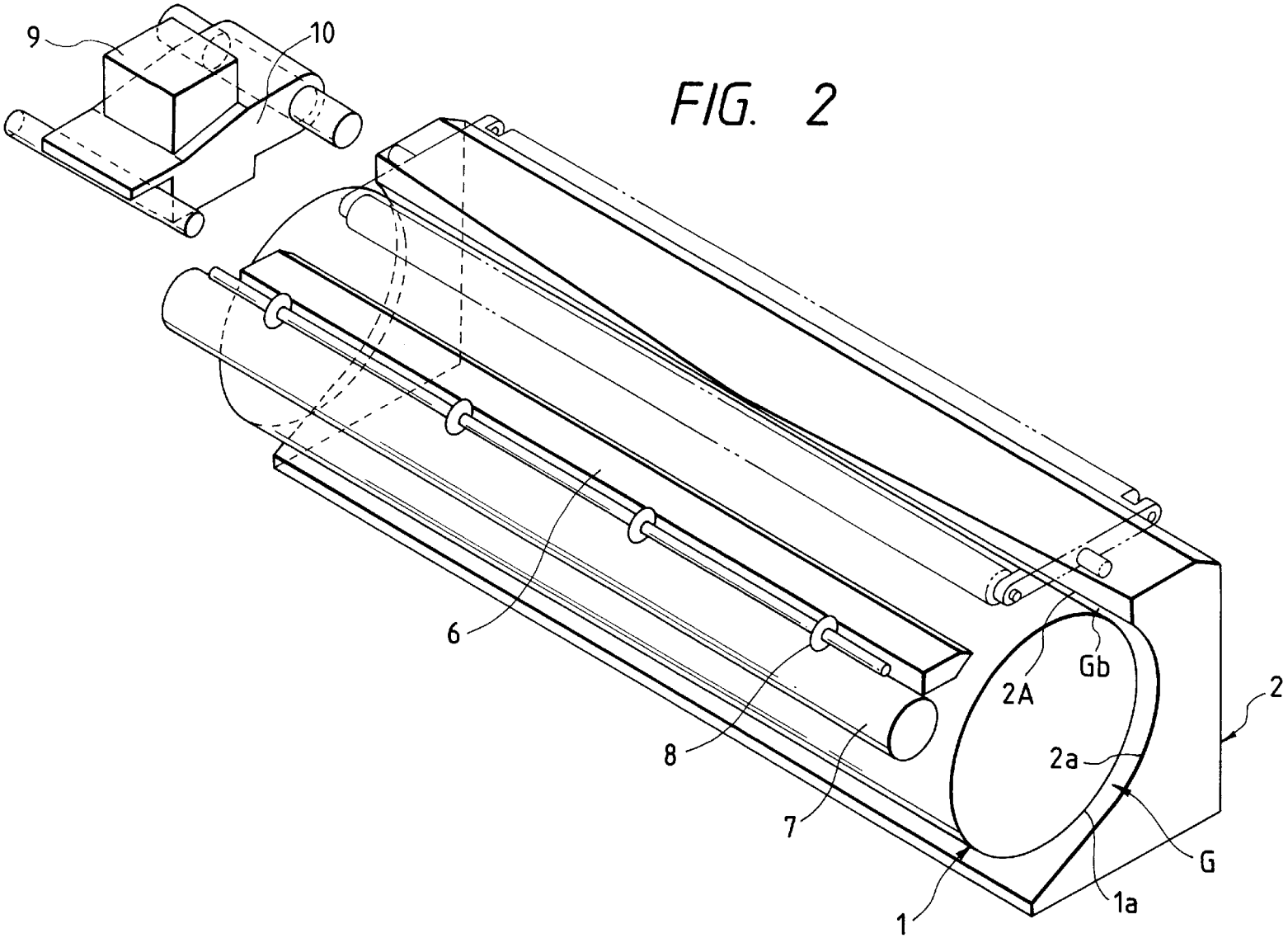
FIG. 2 is a perspective view of the sheet conveying apparatus according to the first embodiment.

A sheet conveying apparatus shown in FIGS. 1 and 2 comprises a convey roller 1, a guide member 2 and a convey sub-roller 5. The convey roller 1 having an outer peripheral surface la is rotatably supported by a frame (not shown) of the sheet conveying apparatus and is rotated in a direction shown by the arrow R1 by a drive means (not shown).

The guide member 2 is disposed to face to the convey roller 1 at the right side. The guide member 2 has an arc-shaped outer guide surface 2*a* facing to the outer peripheral surface 1*a* of the convey roller 1 and substantially coaxial with the outer peripheral surface 1*a* of the convey roller 1, so that a U-turn path G for conveying a sheet P is formed between the outer guide surface 2*a* and the outer peripheral surface 1*a* of the convey roller 1. The U-turn path G has a lower inlet Ga for the sheet P and an upper outlet Gb to change a conveying direction of the sheet from a direction shown by the arrow A to a direction shown by the arrow B. The outlet Gb is defined between a terminal edge 2A (disposed at a downstream end in the sheet conveying direction) of the outer guide surface 2*a* and the generatrix of the outer peripheral surface 1*a* opposed to the terminal edge. The terminal edge 2A is formed along the generatrix of the outer peripheral surface 1*a* (transverse to the sheet conveying direction), but is configured not to coincide with a straight line parallel to a longitudinal axis of the convey roller 1. For example, as shown in FIG. 2, the terminal edge 2A is tapered so that a central portion (in the axial direction) of the terminal edge is convex outwardly. A pinch sub-roller 3 urged against the outer peripheral surface 1*a* of the convey roller 1 is disposed within the U-turn path G.

The convey sub-roller 5 is urged against the outer peripheral surface la of the convey roller 1 immediately at a downstream side of the outlet Gb of the U-turn path G in the sheet conveying direction and is rotatably mounted on a distal end 4*b* of a pressure plate (pressurizing member) 4. The pressure plate 4 can be rocked around a shaft 4*a* (parallel to the generatrix of the convey roller) and a proximal end 4*c* of the pressure plate is biased upwardly by tension springs 4*d*. With this arrangement, the convey sub-roller 5 mounted on the distal end 4*b* is urged against the outer peripheral surface of the convey roller 1 from the above with moderate pressure.

In the illustrated embodiment, a portion (left side portion) of a lower surface of the pressure plate 4 which faces to the outer peripheral surface 1*a* between the outlet Gb and the convey sub-roller 5 acts as an auxiliary guide surface for guiding the sheet P from the outlet Gb to the convey sub-roller 5. Further, a portion (right side portion) of the lower surface of the pressure plate 4 which is contiguous to the downstream auxiliary guide surface acts as a second guide surface, and a straight path G1 for conveying the sheet P in a direction shown by the arrow B is defined between the second guide surface (and the auxiliary guide surface) and an upper surface of the guide member 2.

An image forming portion is disposed downstream of the convey sub-roller 5, and includes a platen 6 for supporting a lower surface of the sheet P during the image formation, a recording head 9 for effecting the recording (for example, by discharging ink onto the sheet P), and a carriage 10 on which the recording head 9 is mounted and which is reciprocally shifted in a direction transverse to the sheet conveying direction. At a downstream side of the image forming portion, there are disposed a discharge roller 7 and spur wheels 8 for pinching and discharging the sheet P on which the image was recorded.

With the arrangement as mentioned above, thick sheet P conveyed from the direction A is pinched between the convey roller I and the pinch sub-roller 3 to be conveyed through the U-turn path G. When a tip end of the sheet leaves the outlet Gb of the U-turn path G, the tip end of the sheet is guided by the pressure plate 4 and then is pinched by the convey sub-roller 5. Thereafter, the sheet P is further conveyed to pass through the platen 6. When the tip end of the sheet is pinched between the discharge roller 7 and the spur wheels 8, the sheet is temporarily stopped.

In this condition, the recording is started. That is to say, first of all, one-line recording is performed by reciprocally shifting the recording head 9 by the carriage 10 while discharging the ink toward the surface of the sheet P, and then, the sheet P is conveyed by the convey roller 1 by a predetermined amount. One-line recording and the predetermined amount conveyance of the sheet are repeated until one-page recording is finished.

In the above sheet conveying apparatus, since there is the straight path G1, it is necessary to form a gap (for the straight path G1) between the upper surface of the guide member 2 and the lower surface of the pressure plate 4. With this arrangement, as mentioned above, when the trail end Pb of the sheet P having great resiliency leaves the terminal edge 2A of the outer guide surface 2*a*, the trail end Pb is snappingly returned to its straight condition, thereby worsening the conveying accuracy.

However, in the illustrated embodiment, as mentioned above, since the terminal edge 2A of the guide member 2 is configured not to coincide with a straight line but to be convex at the central portion, the trail end Pb of the sheet P is gradually disengaged from the terminal edge 2A from its two ends to its central portion. Accordingly, the conveying accuracy is maintained, thereby providing the good image. Further, since any additional braking means or an additional flexible sheet member is not required, the apparatus can be made cheaper and the operability can be improved.

<Second Embodiment>

Figure 3:
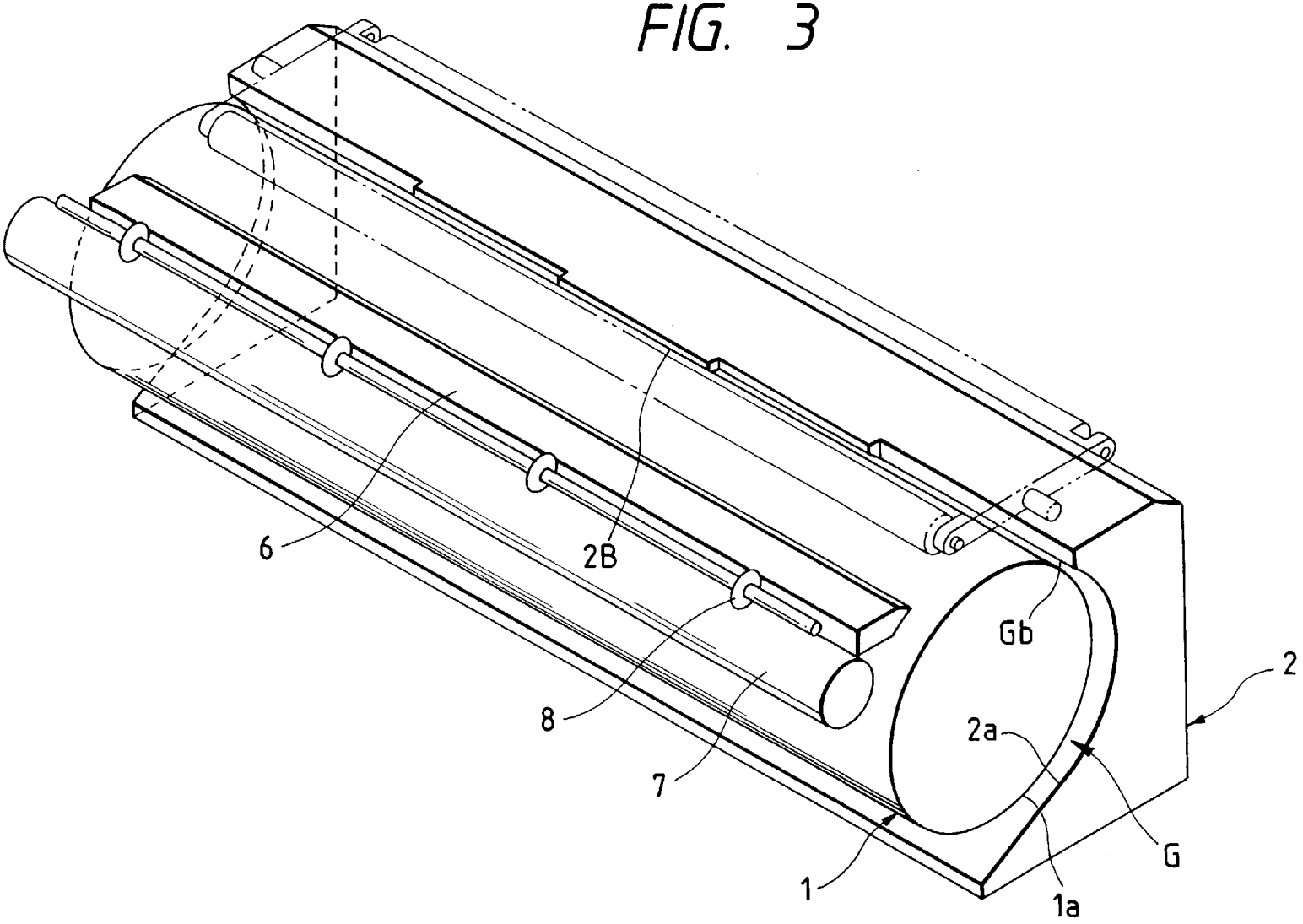
FIG. 3 is a perspective view of a sheet conveying apparatus according to a second embodiment of the present invention.

FIG. 3 is a perspective view showing a sheet conveying apparatus according to a second embodiment of the present invention. In this second embodiment, a terminal edge 2B of the outer guide surface 2*a* is not curved to be convex outwardly (as is in the first embodiment), but is steppingly protruded outwardly (in the sheet conveying direction) from its two ends to its central portion as steps, as shown in FIG. 3. With this arrangement, the trail end Pb of the sheet P is gradually disengaged from the terminal edge 2B from its two ends to its central portion, thereby achieving the same advantage as the first embodiment.

<Third Embodiment>

Figure 4:
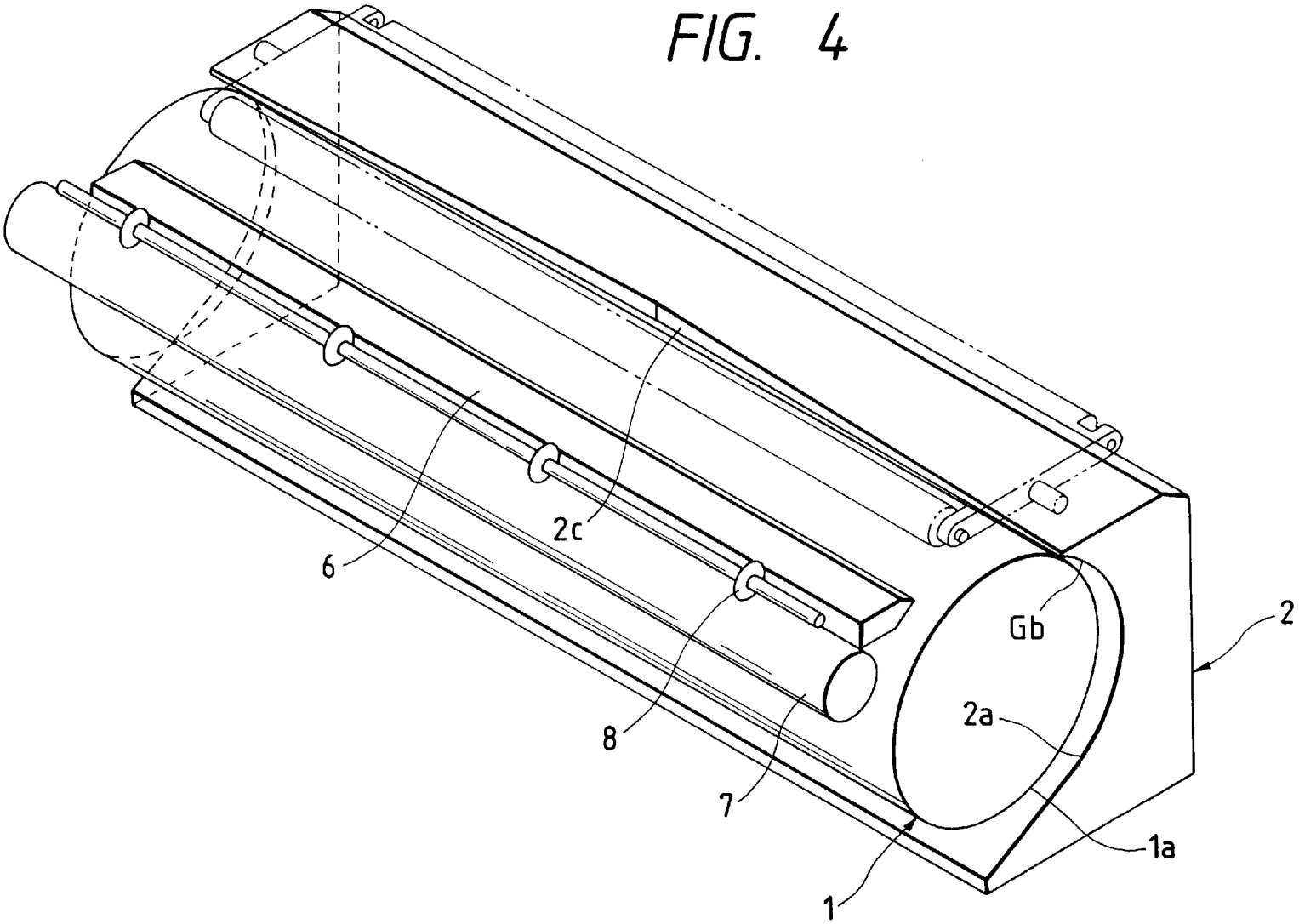
FIG. 4 is a perspective view of a sheet conveying apparatus according to a third embodiment of the present invention.

FIG. 4 is a perspective view showing a sheet conveying apparatus according to a third embodiment of the present invention. In this third embodiment, a terminal edge 2C of the outer guide surface 2*a* is tapered to be concave inwardly at its central portion. With this arrangement, the trail end Pb of the sheet P is gradually disengaged from the terminal edge 2C from its central portion to its two ends, thereby achieving the same advantages as those in the first and second embodiments.

<Fourth Embodiment>

Figure 5:
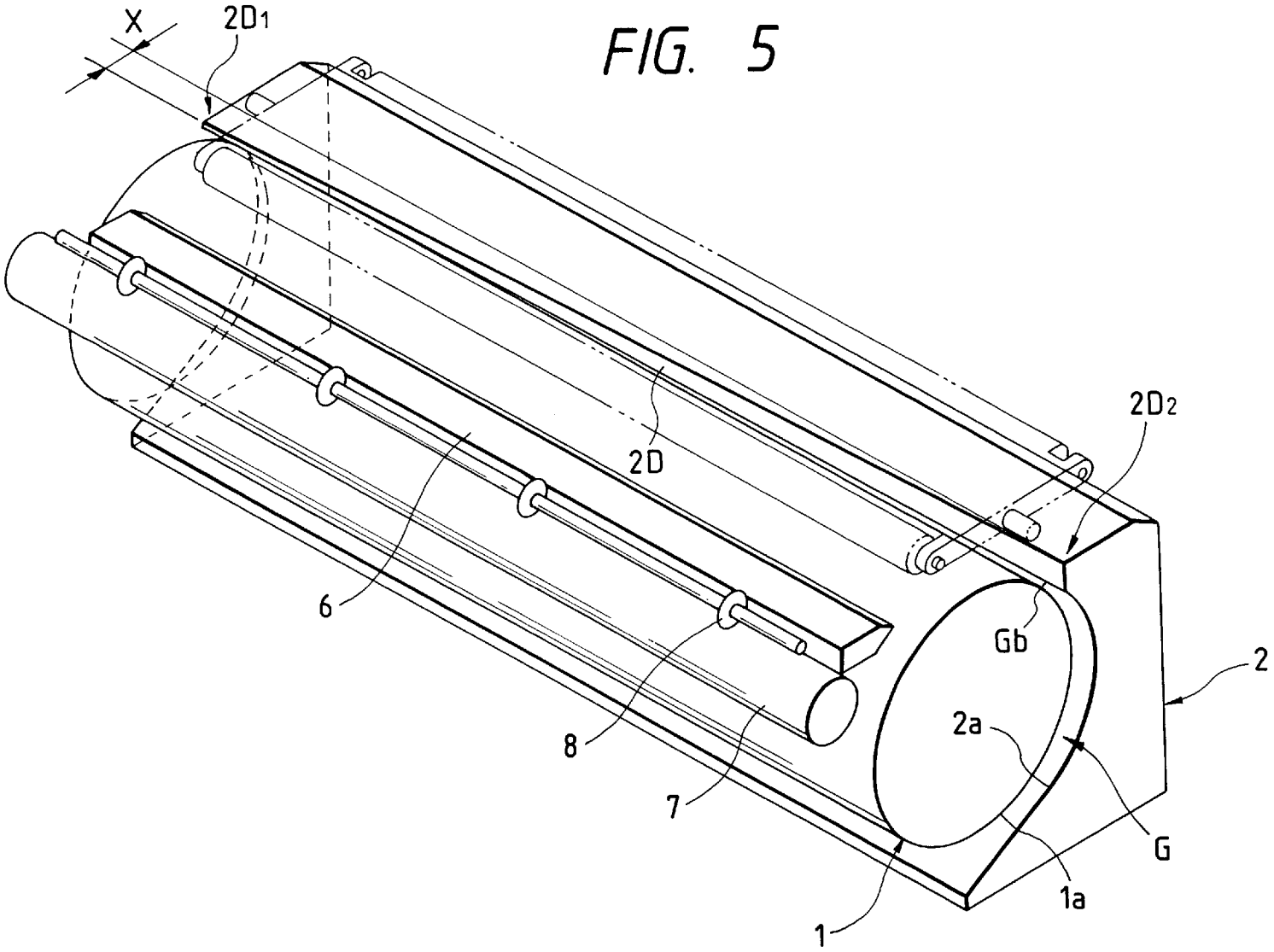
FIG. 5 is a perspective view of a sheet conveying apparatus according to a fourth embodiment of the present invention.
Figure 6:
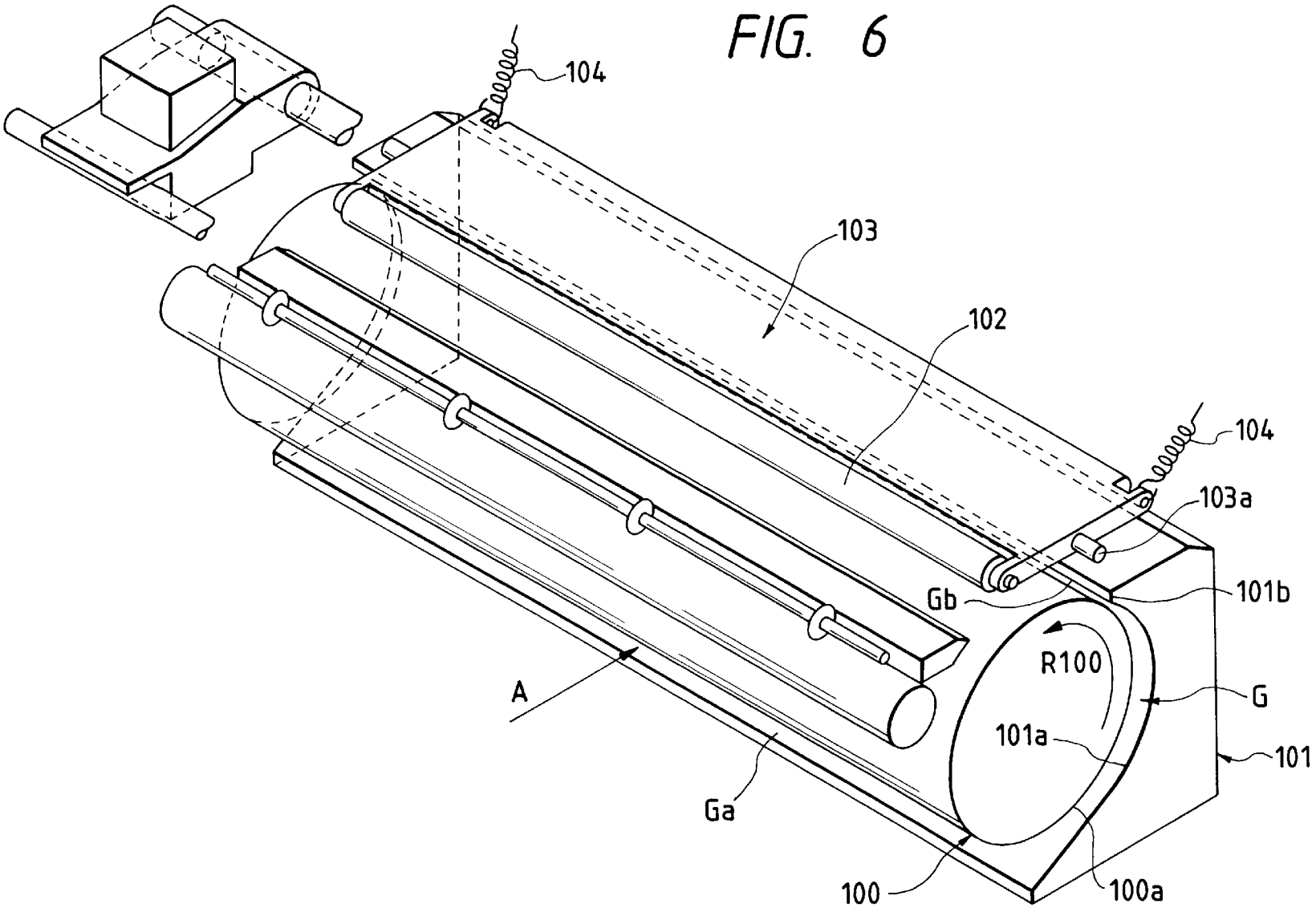
FIGS. 6 and 7 are perspective views of a conventional sheet conveying apparatus.
Figure 7:
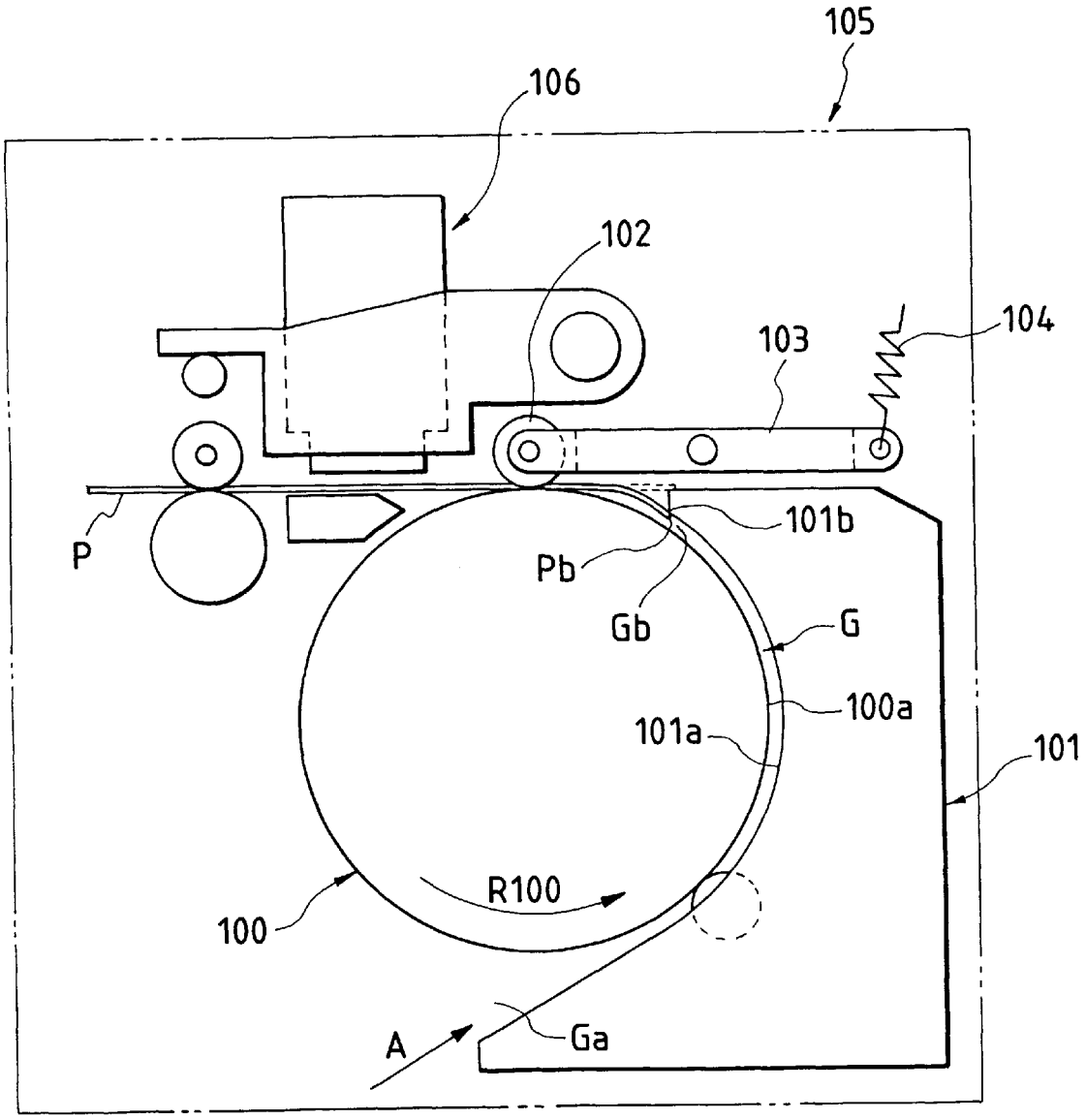

FIG. 5 is a perspective view showing a sheet conveying apparatus according to a fourth embodiment of the present invention. In this fourth embodiment, a terminal edge 2D of the outer guide surface 2*a* is linearly tapered so that one end 2D1 of the terminal edge is protruded from the other end 2D2 in the sheet conveying direction by an amount of X. With this arrangement, the trail end Pb of the sheet P is gradually disengaged from the terminal edge 2D from the left end (end 2D2) to the right end (end 2D1). Also in this embodiment, substantially the same advantages as those in the first to third embodiments can be expected. Incidentally, in the arrangement as shown in FIG. 5, the tapered amount X may be greater than 2 mm. The reason is that, even if the sheet is skew-fed more or less or the dimension of the sheet itself has slight error, the desired advantage can be obtained.

In the above-mentioned first to fourth embodiments, while examples that the terminal edges 2A, 2B, 2C and 2D are tapered or stepped were explained, the terminal edge can be formed by combination of tapers or tapers and steps or may be curved to have an arcuate curvature. That is to say, the terminal edge is not limited to a special configuration, but may be appropriately configured so long as the trail end Pb of the sheet P can be gradually disengaged from the terminal edge. The configuration of the terminal edge may be determined by tests for providing the optimum advantage for various sheets having different size and resiliency or may be selected on the basis of design and/or manufacturing limitations.

As mentioned above, according to the present invention, by using the downstream terminal edge of the outer guide surface of the U-turn path having the configuration other than the straight line, the configuration of the terminal edge can be differentiated from the edge (generally, straight line) of the trail end of the sheet to be disengaged from the terminal edge so that the trail end of the sheet is gradually disengaged from the terminal end. Thus, the shock of the disengagement is reduced to prevent the conveying accuracy from being worsened. As a result, for example, when the image forming portion is disposed immediately at a downstream side of the U-turn path, the poor image due to the reduction in conveying accuracy can be avoided.

In the present invention, the above-mentioned effective advantage can be obtained with a simple construction in which the terminal edge of the outer guide surface is merely altered and without using any additional braking means or additional flexible sheet member. Thus, the apparatus can be made cheaper and the operability can be improved. Incidentally, the configuration of the terminal edge from which the trail end of the sheet is gradually disengaged may be taper(s) of steps.

The recording head used in the above-mentioned embodiments may be an ink jet head which includes heat generating elements disposed in nozzles and in which an ink droplet is discharged from the corresponding nozzle by growth of a bubble generated in the ink by thermal energy from the selected heat generating element.

What is claimed is:

1. A sheet conveying apparatus comprising:

an arcuate U-turn path formed between an outer peripheral surface of a convey roller for conveying a sheet and an outer guide surface curved along said outer peripheral surface to convey the sheet passed through the U-turn path by said covey roller and a convey sub-roller urged against said convey roller, wherein said outer guide surface has a terminal edge disposed at a downstream end thereof in a sheet conveying direction and cooperating with the generatrix of said outer peripheral surface to define an outlet of said U-turn path therebetween, and said terminal edge is configured not to coincide with a straight line parallel with a longitudinal axis of said convey roller.

2. A sheet conveying apparatus according to claim 1, further comprising a pressuring member for urging said convey sub-roller against the outer peripheral surface of said convey roller, said pressuring member having an auxiliary guide surface facing to the outer peripheral surface of said convey roller between the outlet of said U-turn path and said convey sub-roller.

3. A sheet conveying apparatus according to claim 2, wherein said pressuring member has a second guide surface contiguous to said auxiliary guide surface so that said second guide surface and said auxiliary guide surface form a part of a straight path extending to said convey sub-roller.

4. A recording apparatus comprising:

a first guide for forming an arcuate sheet convey path and being disposed inside of the arcuate sheet convey path;

a second guide for forming the arcuate sheet convey path and being disposed outside of the arcuate sheet convey path, wherein a terminal edge of said second guide in a sheet convey direction has a shape which does not coincide with a straight line in a direction perpendicular to the sheet convey direction so that a trail end of a sheet conveyed through the arcuate sheet convey path passes the terminal edge of said second guide gradually; and recording means for recording an image on the sheet passed through the arcuate sheet convey path.

5. A recording apparatus according to claim 4, further comprising a second convey path joining to a vicinity of an outlet of the arcuate sheet convey path.

6. A recording apparatus according to claim 5, further comprising sheet convey means between said second convey path and said recording means.

7. A recording apparatus according to claim 4, wherein said second guide comprises a convey roller.

8. A recording apparatus according to claim 4, wherein said recording means is an ink jet head for forming the image on the sheet by discharging ink.

9. A recording apparatus according to claim 8, wherein said recording means forms the image by using an ink droplet discharged by thermal energy.

* * * * *

UNITED STATES PATENT AND TRADEMARK OFFICE

CERTIFICATE OF CORRECTION

PATENT NO. : 5,913,511
DATED : June 22, 1999
INVENTOR(S) : Yasuo Miyauchi

It is certified that error appears in the above-identified patent and that said Letters Patent is hereby corrected as shown below:

Title page,
Item [56], References Cited, FOREIGN PATENT DOCUMENTS,
"355066432" should read -- 55-66432 --, and "405024715" should read -- 5-24715 --.

Column 2,
Line 29, "worsen" should read -- worsens --.

Column 4,
Line 32, "roller I" should read -- roller 1 --.

Signed and Sealed this

Second Day of July, 2002

*Attest:*

*Attesting Officer*

JAMES E. ROGAN
*Director of the United States Patent and Trademark Office*